US007314151B2

(12) United States Patent
Myoji

(10) Patent No.: US 7,314,151 B2
(45) Date of Patent: Jan. 1, 2008

(54) PRESSING APPARATUS FOR CLOTHING

(75) Inventor: Motoya Myoji, Akishima (JP)

(73) Assignee: Y.A.C. Co., Ltd., Tokyo (JP)

( * ) Notice: Subject to any disclaimer, the term of this patent is extended or adjusted under 35 U.S.C. 154(b) by 0 days.

(21) Appl. No.: 11/546,229

(22) Filed: Oct. 10, 2006

(65) Prior Publication Data

US 2007/0151996 A1 Jul. 5, 2007

(30) Foreign Application Priority Data

Oct. 12, 2005 (JP) ..... 2005-297143

(51) Int. Cl.
*A41H 5/00* (2006.01)

(52) U.S. Cl. ..... 223/70; 223/73

(58) Field of Classification Search ..... 223/1, 223/52, 57, 66, 70, 73, 76; 38/7, 10, 11, 38/20, 22, 23, 138
See application file for complete search history.

(56) References Cited

U.S. PATENT DOCUMENTS 3,378,178 A * 4/1968 Stewart ..... 223/57
3,568,900 A * 3/1971 Paris ..... 223/70
4,728,015 A * 3/1988 Holzapfel et al. ..... 223/70
6,758,377 B2 * 7/2004 Uchikoshi ..... 223/73
2005/0150918 A1 * 7/2005 Ho ..... 223/73

FOREIGN PATENT DOCUMENTS

JP 2-46880 12/1990
JP 3-44560 7/1991

* cited by examiner

*Primary Examiner*—Gary L. Welch
*Assistant Examiner*—Andrew W Sutton
(74) *Attorney, Agent, or Firm*—William L. Androlia; H. Henry Koda

(57) ABSTRACT

A pressing apparatus for clothing including a dummy torso, grip members for gripping end portions of both sleeves of a shirt, a rear ironing member, and a front ironing member; the front ironing member being comprised of a left front ironing member and a right front ironing member that are respectively movable between the outside of the grip members and the front of the dummy torso so that when moved to the front of the dummy torso the diagonally extending inside edges of the left and right front ironing members come in contact to mate each other with the mated inside edges located on one side of a vertical center line of the dummy torso and a shirt put on the dummy torso.

2 Claims, 4 Drawing Sheets

PRESSING APPARATUS FOR CLOTHING

BACKGROUND OF THE INVENTION

1. Field of the Invention

The present invention relates to a pressing apparatus for clothing for press-finishing jackets such as shirts and the like which have been laundered.

2. Description of the Related Art

A pressing apparatus for clothing includes a dummy torso modeled after the shape of an upper half of the human body, a pair of front ironing member and rear ironing member pressed against the front and back surfaces of the dummy torso, grip members for gripping the end portions of both sleeves of a jacket placed on the dummy torso, and tuck ironing members pressed against the tucks of the sleeves. As this kind of pressing apparatus for clothing, Japanese Utility Model Application Publication (Kokoku) No. 2-46880 and Japanese Patent Application Publication (Kokoku) No. 3-44560, for example, can be listed.

Such pressing apparatus for clothing employ a construction that a dummy torso and front and rear ironing members are relatively moved horizontally, so that it is possible to make the task of putting the jacket on and off the dummy torso and the task on the sleeves of the jacket safe and quick. In Patent References 1 and 2, putting a jacket on a dummy torso is performed in such a manner that the front and rear ironing members are positioned at the left side grip member that holds the cuff of the left sleeve of a jacket to be ironed, the jacket is next overlaid on the dummy torso; after that, the cuff of the right sleeve is fixed by the right side grip member; then the dummy torso is moved to a press position between the front and rear ironing members; and then the cuff of the left sleeve of the jacket is fixed by the left side grip member.

As described above, when putting a jacket on the dummy torso, after the jacket is overlaid on the dummy torso, one of the cuffs is fixed by one of the grip members, and next, the dummy torso and the front and rear ironing members are moved relative to each other so that the dummy torso is positioned between the front and rear ironing members, and after that, the worker moves to the other grip member side and fixes the other cuff to the other grip member. Thus, a large number of work processes are required, and the movement range of the worker is large; accordingly, there is a problem that the productivity is poor.

BRIEF SUMMARY OF THE INVENTION

The object of the present invention is to provide a pressing apparatus for clothing that makes the clothing mounting task even faster, thus increasing the productivity.

The above object is accomplished by a unique structure of the present invention for a pressing apparatus that includes at least: a dummy torso modeled after a shape of an upper half of a human body, a pair of grip members for gripping end portions of both sleeves of a shirt or the like overlaid on the dummy torso, a rear ironing member provided on the back side of the dummy torso so as to be pressed against the dummy torso, and a front ironing member provided on the front side of the dummy torso so as to be pressed against the dummy torso; and in this pressing apparatus:

the front ironing member is comprised of a pair of left front ironing member and right front ironing member divided in a vertical direction, the left and right front ironing members are provided so as to be moved from the outside of the grip member to the front side of the dummy torso, thus allowing the inside edge of the left front ironing member and the inside edge of the right front ironing member come in contact to mate each other, a horizontal drive means for driving the left and right front ironing members in a horizontal direction is provided, and a pressing drive means for driving the respective left and right front ironing members to be pressed against the dummy torso is provided.

In the above structure of the pressing apparatus of the present invention, the inside edge of the left front ironing member is formed straight with the top end part of the inside edge being on the outside of the center line of the dummy torso, and the bottom end part thereof being at approximately the center line of the dummy torso, and the inside edge of the right front ironing member is slanted so as to mate the inside edge of the left front ironing member.

As seen from the above, the front ironing member is comprised of a pair of left front ironing member and right front ironing member that are divided in a vertical direction, and these left and right front ironing members are provided so as to be moved from the outside of the grip member to the front side of the dummy torso. Accordingly, when setting a shirt on the dummy torso and on the pair of grip members, such setting is performed with the left and right front ironing members positioned on the outside of the grip members, so that the worker can put the shirt on the dummy torso near the dummy torso; and it is also possible to hold the end portions of both sleeves of the shirt on the respective grip members. Furthermore, after the mated left and right front ironing members are moved to the front side of the dummy torso, iron-finishing for the back part, trunk part, and chest part of the shirt are performed. Thus, there are fewer work processes, and it is also possible for the worker to work in a smaller movement range, thus improving the productivity.

DETAILED DESCRIPTION OF THE INVENTION

An embodiment of the pressing apparatus for clothing of the present invention will be described below with reference to FIG. 1 through FIG. 4. The feature of the present invention is in the construction of the front ironing member, and the remaining structure is known conventionally. Accordingly, the known construction belonging to the conventional art will be illustrated concisely, and the description thereof will be made briefly.

Figure 3:
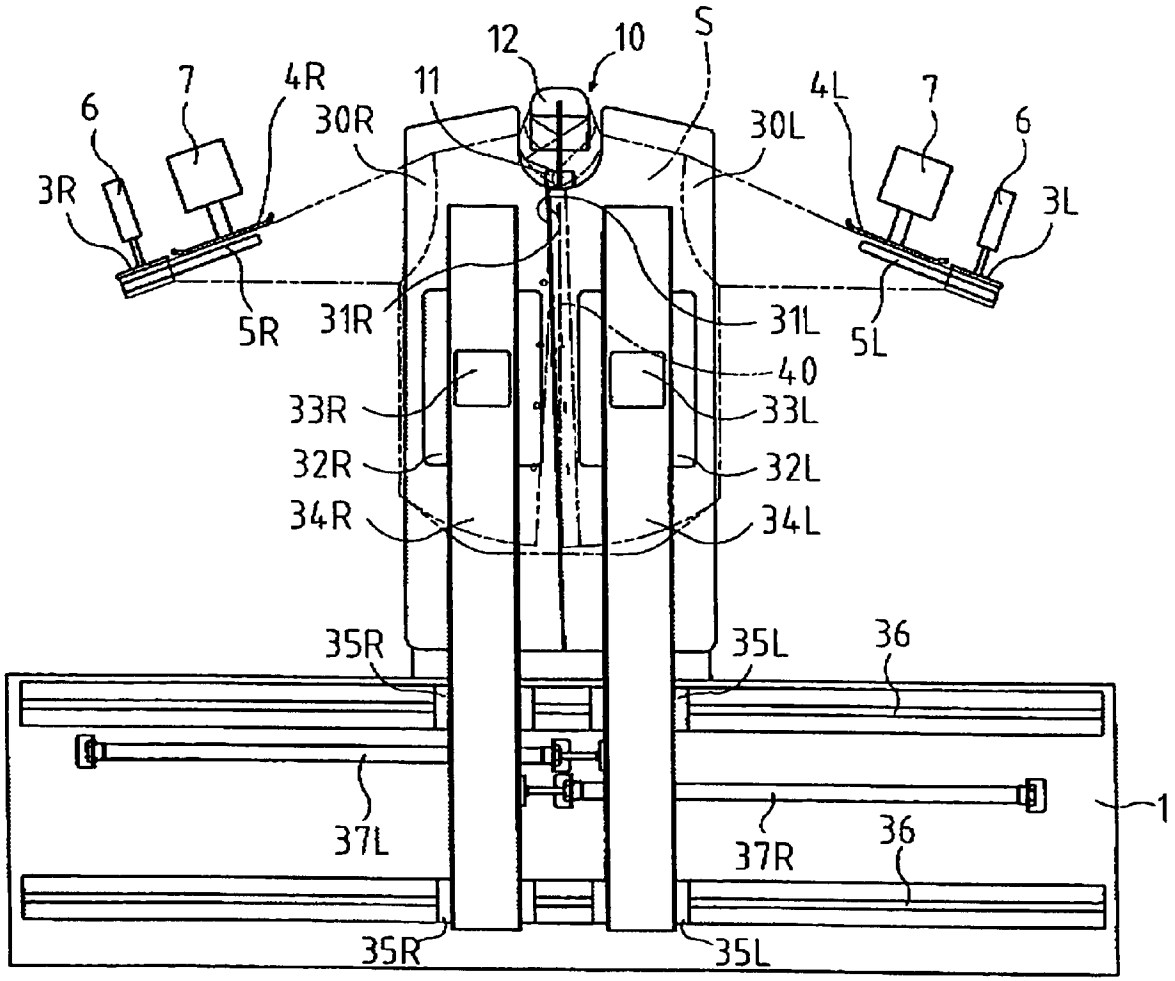
FIG. 3 is a front view of the iron-finishing status by operating the left and right front ironing members and the rear ironing member.
Figure 4:
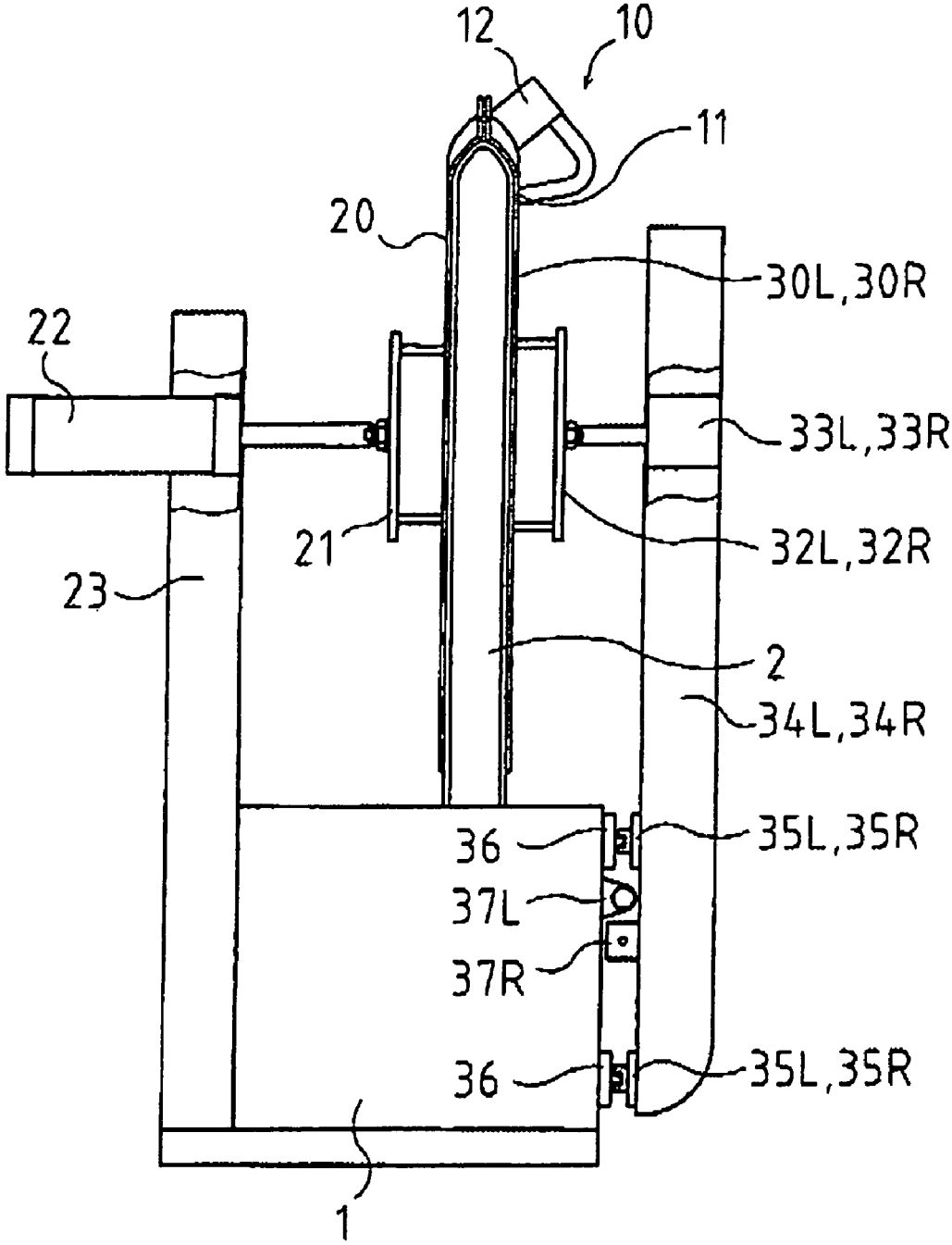
FIG. 4 is a side view thereof.

First, the known construction will be described. On a base 1, a dummy torso 2 modeled after the shape of the upper half of a human body is erected and attached thereto. Provided at the left and right sides of the dummy torso 2 are one pair of grip members 3L and 3R that grip the cuffs of both sleeves of a shirt S, tuck ironing members 4L and 4R for ironing the sleeve tucks, and ironing bases 5L and 5R. The grip members 3L and 3R and the tuck ironing members 4L and 4R are respectively operated by air cylinders 6 and 7. The grip members 3L and 3R, the tuck ironing members 4L and 4R, and the ironing bases 5L and 5R are provided so as to be able to move, by a drive means (not illustrated), outwardly and diagonally downward direction as shown in FIG. 3 from the state shown in FIG. 1, so that both sleeves of the shirt S are stretched out.

A neck holder 10 is provided on the upper portion of the dummy torso 2 so as to fix the neck part of the shirt S. The neck holder 10 is comprised of a holding plate 11, which fixes positionally the front side of the neck part of the shirt S, and an air cylinder 12, which drives this holding plate 11. On the back side of the dummy torso 2 is provided a rear ironing member 20, and this rear ironing member 20 is secured to a supporting plate 21. The supporting plate 21 is secured to the operating rod of an air cylinder 22, and the air cylinder 22 is secured to a support frame 23 which is secured to the base 1.

Next, the construction that is the feature of the shown embodiment will be described. The front ironing member is comprised of a pair of a left front ironing member 30L and a right front ironing member 30R that are divided in a vertical direction from approximately the center. Here, the inside edge 31L of the left front ironing member 30L is formed to be slanted so that the top end part of the inside edge 31L is approximately 2 cm outside the center line 40 of the dummy torso 2, and the bottom end part of the inside edge 31L is on approximately the center of the dummy torso 2. The inside edge 31R of the right front ironing member 30R is formed slanted so as to match the slanted inside edge 31L of the left front ironing member 30L. The left and right front ironing members 30L and 30R are respectively secured to the support plates 32L and 32R, and the support plates 32L and 32R are respectively driven by the air cylinders 33L and 33R. The air cylinders 33L and 33R are secured to the support frames 34L and 34R provided so as to extend upward on the front side of the base L.

The support frames 34L and 34R are respectively provided at their bottoms with sliders 35L and 35R, and these sliders 35L and 35R are fitted in guide rails 36 which are installed horizontally and secured to the base 1. The base 1 has left and right air cylinders 37L and 37R at symmetrical positions on left and right of the base 1 so that the cylinders drive the left and right front ironing members 30L and 30R to move between the positions shown in FIG. 1 and the positions shown in FIG. 3. More specifically, the operating rod of the left air cylinder 37L is secured to the support frame 34L, and the operating rod of the right air cylinder 37R is secured to the support frame 34R.

Figure 1:
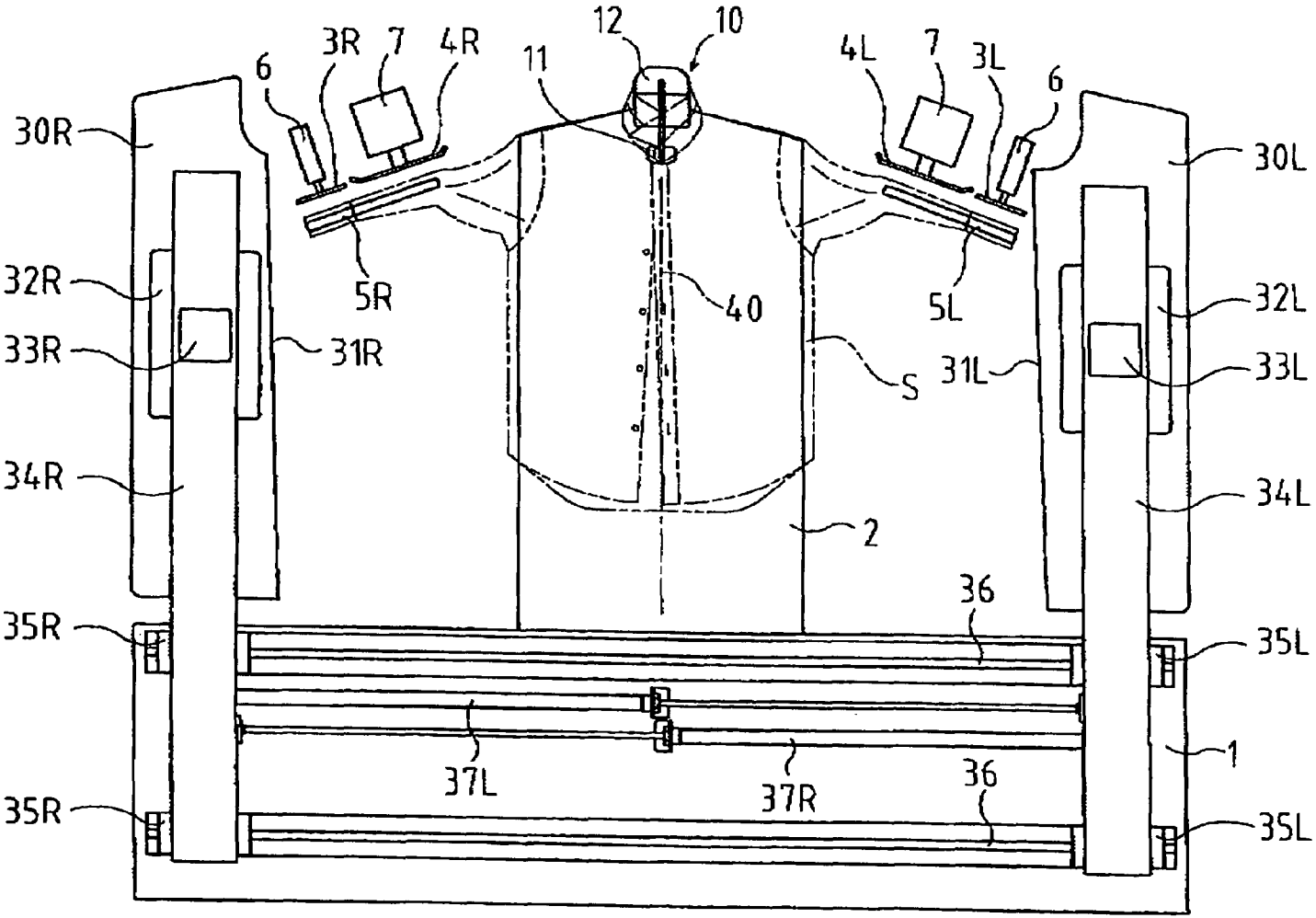
FIG. 1 is a front view of the pressing apparatus for clothing according to one embodiment of the present invention, showing the state before the right front ironing member and the rear ironing member are operated.
Figure 2:
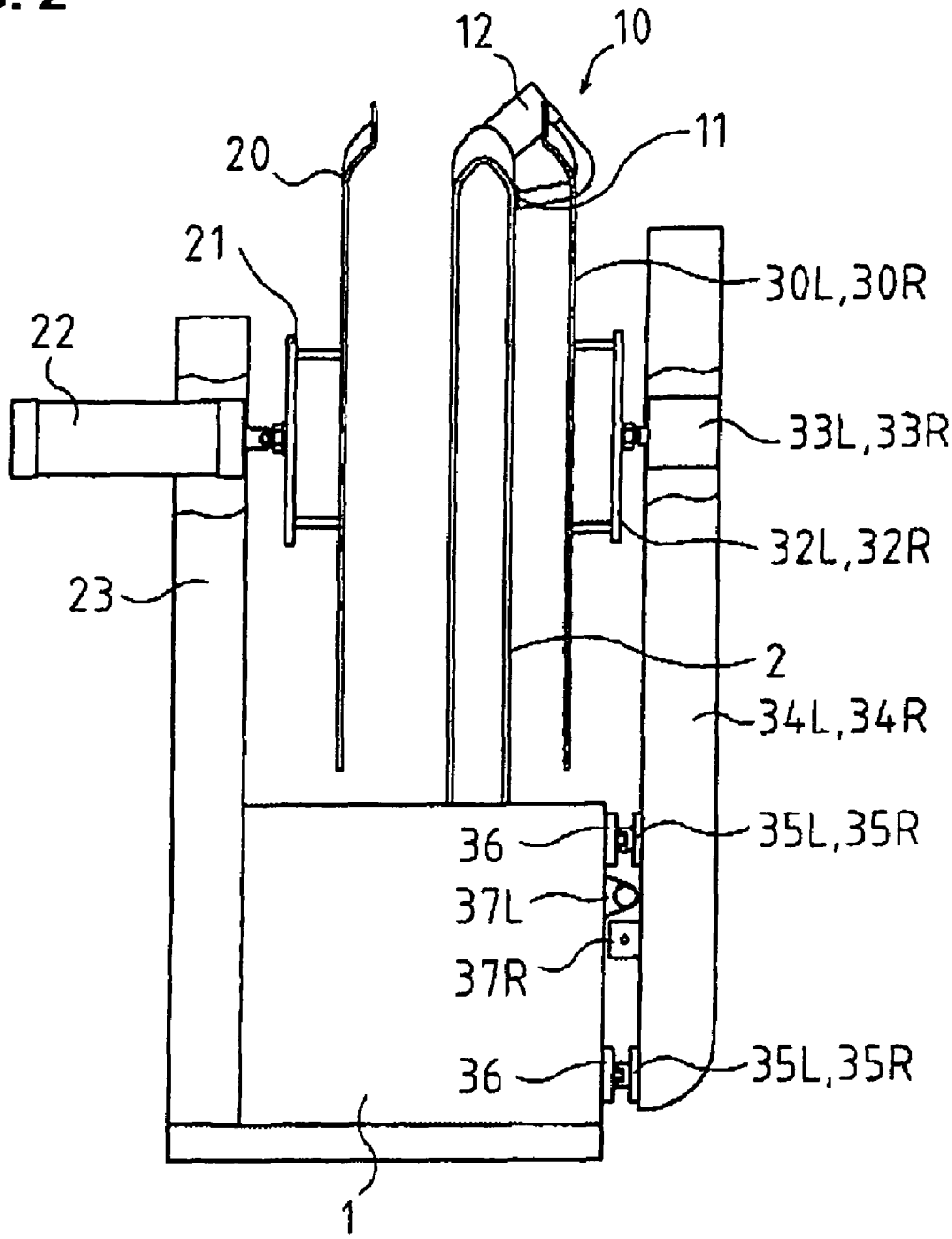
FIG. 2 is a side view thereof.

Next, the operation will be described. Before the start of operation, as shown in FIG. 2, the rear ironing member 20 is separated from the back of the dummy torso 2, and the left and right front ironing members 30L and 30R are, as shown in FIG. 1, respectively separated from the front of the dummy torso 2; and in addition, as seen from FIG. 1, the left and right front ironing members 30L and 30R are respectively positioned outside the grip members 3L and 3R. In addition, the grip members 3L and 3R, the tuck ironing members 4L and 4R, and the ironing bases 5L and 5R are at positions near the dummy torso 2. In this state, a shirt S is overlaid on the dummy torso 2, and then the air cylinder 12 is operated, so that the front side of the neck part of the shirt S is fixed by the holding plate 11. Also, the bottom part of the front side of the shirt S is fixed by a front holding tool that is not illustrated. Subsequently, vacuum suction is operated on the dummy torso 2, so that the shirt S is vacuum suctioned to the dummy torso 2. Next, the cuff of both sleeves of the shirt S are brought to pass through the ironing base 5L and 5R, the cuffs are held (gripped) by the respective grip members 3L and 3R. By doing this, the cuffs of the sleeves of the shirt S are held with the sleeves having slack.

After the shirt S is set on the dummy torso 2 in the manner as described above, the left and right air cylinders 37L and 37R are operated. With this operation of the left and right air cylinders 37L and 37R, the operating rod of the left and right air cylinders 37L and 37R are drawn in, and as shown in FIG. 3, the left and right front ironing members 30L and 30R are moved to the front of the dummy torso 2, which is a press position, via the support frames 34L and 34R, and the inside edges of the left and right front ironing members 30L and 30R are brought into contact to mate each other. Subsequently, the air cylinder 22 and the left and right air cylinders 37L and 37R are operated, so that the rear ironing member 20 and the left and right front ironing members 30L and 30R are respectively pressed against the back and front of the dummy torso 2, and the back part, the trunk part, and the chest part of the shirt S undergo iron-finishing.

While the rear ironing member 20 and the left and right front ironing members 30L and 30R are pressing on the back and the front of the dummy torso 2, the grip members 3L and 3R, the tuck ironing members 4L and 4R, and the ironing bases 5L and 5R, are, as shown in FIG. 3, moved outwardly and diagonally downward direction, so that both sleeves of the shirt S are stretched out; and in that state, the tucks of the sleeves are sandwiched between the ironing bases 5L and 5R and the tuck ironing members 4L and 4R, and iron-finishing thereof is performed. During the ironing by the rear ironing member 20, the left and right front ironing members 30L and 30R, and the tuck ironing members 4L and 4R, hot air is blown onto the dummy torso 2, so that the wrinkles in the surface of the underarms and sleeve openings of the shirt S are stretched and, at the same time, dried. After iron-finishing, by the reverse operation from the operation described above, the status shown in FIG. 3 and FIG. 4 is back to the original state shown in FIG. 1 and FIG. 2.

As seen from the above, the front ironing member is comprised of the left front ironing member 30L and the right front ironing member 30R divided in a vertical direction, and these left and right front ironing members 30L and 30R are provided so as to be moved from the outside of the grip members 3L and 3R to the front side of the dummy torso 2. Accordingly, when the shirt S is to be set on the dummy torso 2 and on the grip members 3L and 3R, such a setting is performed with the left and right front ironing members 30L and 30R positioned outside the grip members 3L and 3R. As a result, the worker can put the shirt S on the dummy torso 2 in a state that the worker is near the dummy torso 2, and the cuff of both sleeves of the shirt S can be held respectively by the grip members 3L and 3R. After that, once the mated inside edges of the left and right front ironing members 30L and 30R are moved to the front side of the dummy torso 2, iron-finishing of the back part, the trunk part, and the chest part of the shirt S is performed. As seen from the above, there are fewer work processes, and the worker movement range is reduced, improving the productivity.

In the above-described embodiment, the front ironing member is comprised of a pair of left and right front ironing members 30L and 30R that are divided in two. Accordingly, there is a risk that a part of the shirt S that correspond to the longitudinal line part of the mated inside edges of the left and right front ironing members 30L and 30R is not ironed. If the vertical line part of the shirt S for which there is the risk that ironing would not be performed is on the button hole side of the front portion of shirt S, such a part will stand out when the shirt S is worn, indicating poor iron quality.

However, in the shown embodiment, the inside edge 31L of the left front ironing member 30L is slanted so that the top end part of the inside edge 31L is outside the center line 40 of the dummy torso 2 and the bottom end part is approximately at the center of the dummy torso 2; and the inside edge 31R of the right front ironing member 30R is slanted so as to match the slanted inside edge 31L of the left front ironing member 30L. Because of this structure, the mated inside edges 31L and 31R of the left and right front ironing members 30L and 30R are located on the button-attached side of the front portion of the shirt S during the pressing (shown in FIG. 3 and FIG. 4) by the front ironing member. Therefore, even the vertical line part of the shit that is not pressed by the mated inside edges of the left and right front ironing members 30L and 30R, this part is the button-attached side, and this button-attached side is under the button hole side of the shirt S when the shirt S is worn; accordingly, the pressing quality is not affected.

It should be noted that in the shown embodiment, the inside edge 31L of the left front ironing member 30L is slanted so that the top end part of the inside edge 31L is off the center line 40 of the dummy torso 2 and the bottom end part is approximately on the center of the dummy torso 2. However, it is also possible to have the bottom end part to be located directly straight down below the top end part to be parallel to the center line 40 of the dummy torso 2.

The invention claimed is:

1. A pressing apparatus for clothing comprising at least:

a dummy torso modeled after a shape of an upper half of a human body, a pair of grip members for gripping end portions of both sleeves of a shirt or the like overlaid on said dummy torso, a rear ironing member provided on a back side of said dummy torso so as to be pressed against said dummy torso, and a front ironing member provided on a front side of said dummy torso so as to be pressed against said dummy torso; wherein, said front ironing member is comprised of a pair of left front ironing member and right front ironing member divided in a vertical direction, said left and right front ironing members are provided so as to be moved from an outside of said grip member to the front side of said dummy torso, thus allowing an inside edge of said left front ironing member and an inside edge of said right front ironing member come in contact to mate each other, a horizontal drive means for driving said left and right front ironing members in a horizontal direction is provided, and a pressing drive means for driving said respective left and right front ironing members to be pressed against said dummy torso is provided.

2. The pressing apparatus for clothing according to claim 1, wherein the inside edge of said left front ironing member is formed in a straight line shape with a top end part of the inside edge being on an outside of a center line of said dummy torso, and a bottom end part thereof being at approximately the center line of said dummy torso, and the inside edge of said right front ironing member is slanted so as to mate the inside edge of said left front ironing member.

* * * * *